US006412666B1

(12) United States Patent
Hogan et al.

(10) Patent No.: US 6,412,666 B1
(45) Date of Patent: Jul. 2, 2002

(54) FLUID CONTAINER WITH A KEYING MEANS TO PREVENT IMPROPER FLUID LOADING IN A FLUID DELIVERY TOOL AND A SYSTEM INCLUDING SUCH FLUID CONTAINER AND FLUID DELIVERY TOOL

(75) Inventors: Dennis Pleegor Hogan, Chittenden; Christopher Edward Walsh, Swanton; Charles Arthur Whiting, Milton, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/811,846

(22) Filed: Mar. 19, 2001

(51) Int. Cl.[7] ..... B65D 88/54

(52) U.S. Cl. ..... 222/325; 222/183; 222/131; 220/669

(58) Field of Search ..... 222/325, 183, 222/131; 220/669, 670, 671, 694; 215/12.1

(56) References Cited

U.S. PATENT DOCUMENTS 1,927,553 A * 9/1933 Lusher ..... 221/61
4,974,753 A * 12/1990 Tucker et al. ..... 222/181
5,704,484 A * 1/1998 Spinks et al. ..... 206/521
5,875,921 A 3/1999 Osgar et al.
5,924,599 A 7/1999 Brown
5,924,600 A 7/1999 Keller
6,001,249 A 12/1999 Bailey et al.
6,015,068 A 1/2000 Osgar et al.
6,206,240 B1 * 3/2001 Osgar et al. ..... 222/39

* cited by examiner

*Primary Examiner*—William C. Doerrler
*Assistant Examiner*—Frederick C Nicolas
(74) *Attorney, Agent, or Firm*—Connolly Bove Lodge & Hutz LLP

(57) ABSTRACT

A fluid delivery system that includes a fluid delivery tool having a connector element and a location for holding a fluid container. The fluid container location of the tool has a replaceable template with a first key element portion. The fluid delivery system also includes a fluid container having a connector portion for connecting the fluid container to the connector element of the fluid delivery tool so that the fluid in the fluid container may be delivered to the fluid delivery tool. The fluid container may also have a second key element portion distinct from its connector portion and configured to mate with the first key element portion of the tool template. Alternatively, the fluid container may have a body portion integral with and distinct from its connector portion, and a key element is provided on at least a portion of the fluid container body portion and configured to mate with the first key element portion of the tool template. In this configuration, the key element may be removable from or permanently attached to the body portion of the fluid container. The fluid delivery system ensures that only a fluid container key element capable of mating with the key element portion of the template presently located in the fluid delivery tool may be inserted in the container holding location of the fluid delivery tool.

20 Claims, 2 Drawing Sheets

FLUID CONTAINER WITH A KEYING MEANS TO PREVENT IMPROPER FLUID LOADING IN A FLUID DELIVERY TOOL AND A SYSTEM INCLUDING SUCH FLUID CONTAINER AND FLUID DELIVERY TOOL

BACKGROUND OF THE INVENTION

A. Field of the Invention

The present invention relates generally to fluid delivery systems, and, more particularly to a fluid container with a keying means to prevent improper fluid loading in a fluid delivery tool, and a system including such fluid container and fluid delivery tool.

B. Description of the Related Art

Certain manufacturing processes require the use of fluids such as liquid chemicals. Such liquid chemicals may include, for example, acids, solvents, bases, photoresists, dopants, inorganics, organics, biological solutions, pharmaceuticals, and radioactive chemicals. Often, these processes require a specific liquid chemical for each particular process. Furthermore, each process may require a specific liquid chemical at various stages of the process. For example, two to eight different photoresists might be used in the same lithography cluster during a semiconductor manufacturing process. Storage and dispensing systems allow alternative containers to be used to deliver liquid chemicals to a manufacturing process at a specified time. Consequently, manufacturing personnel need to change the liquid chemical being used for the particular process at the specified time so that the system delivers the correct liquid chemical to the manufacturing process. It is critical that the proper liquid chemical be installed into the systems for the particular process or the particular stage of the process. If the incorrect liquid chemical is installed for a particular process or process stage, personnel may be put at risk, and equipment and the manufactured articles may be severely damaged.

Some conventional systems attempt to utilize unique pump connectors that will only fit with a correct dispensing portion of a container (e.g., the container mouth or chemical connection). Each dispensing portion of the container has a unique configuration based on the liquid chemical contained therein. For example, some containers have keyed, screw-on fill nozzles that prevent the insertion of the containers into an incorrect chemical fill reservoir of a tool. The intention is that only the correct chemical can be used in any particular manufacturing process, because the process will dictate a unique pump connection and a corresponding container with the correct chemical liquid. Such systems, however, permit the pump connectors to be partially connected to the incorrect chemicals such that pumping can take place even though the connection is not proper. In addition, personnel have a propensity to attach the wrong chemical to the wrong process or at the wrong time. Such incorrect connections can be dangerous to personnel and have caused millions of dollars of damage to equipment and to articles of manufacture.

Another conventional system includes the liquid chemical dispensing systems sold under the trade name NowPak (TM) and disclosed in U.S. Pat. Nos. 5,875,921 and 6,015,068. The Nowpak (TM) system has a probe that permits entry of the chemical, but will only seat properly if the container's keyed, screw-on dispensing portion matches a key provided on the top of the probe. The NowPak (TM) system also has a sensor that prevents tool operation when the probe is not seated properly on the container's dispensing portion.

Unfortunately, the probe in such systems becomes contaminated when it is inserted into an incorrect container, and there is nothing to prevent manufacturing personnel from inserting the wrong container within a tool. Furthermore, when an incorrect container is used, the fluid or chemical in the container becomes contaminated, or, even worse, may creates a dangerous chemical reaction between the chemical currently on the probe and the chemical in the incorrect container. Such situations result in waste of costly manufacturing materials, and possibly place manufacturing personnel in danger of being harmed by the reacting chemicals.

Other methods for preventing improper chemical mixing rely on manual or automated methods. For example, bar code labeling and scanning identifies when an incorrect chemical is loaded into a tool, but requires an operator to perform the bar code scanning and react to an error. Another even more manual method includes having a second person check the chemical loading. This method is similarly unreliable.

Thus there is a need in the art to provide a keyed fluid container that prevents manufacturing personnel from inserting an incorrect container into an incorrect manufacturing tool, and thus, contaminating a tool probe, as well as intermingling incompatible chemicals located in the probe and the incorrect container.

SUMMARY OF THE INVENTION

The present invention satisfies this need by providing a fluid container with a keying means to prevent improper fluid loading in a fluid delivery tool, and a system including such fluid container and fluid delivery tool.

Additional advantages of the invention will be set forth in part in the description which follows, and in part will be learned from the description, or may be learned by practice of the invention. The advantages of the invention will be realized and attained by means of the elements and combinations particularly pointed out in the appended claims.

In accordance with the purpose of the invention, as embodied and broadly described herein, the invention comprises a fluid delivery system, including: a fluid delivery tool having a connector element and a location for holding a fluid container, the location including a replaceable template having a first key element portion; and a fluid container having a connector portion for connecting the fluid container to the connector element of the fluid delivery tool for delivery of the fluid in the fluid container to the fluid delivery tool, the fluid container further having a second key element portion distinct from the connector portion of the fluid container and configured to mate with the first key element portion of the tool template.

Further in accordance with the purpose of the invention, as embodied and broadly described herein, the invention comprises a fluid delivery system, including: a fluid delivery tool having a connector element and a location for holding a fluid container, the location including a replaceable template having a key element portion; a fluid container having a connector portion for connecting the fluid container to the connector element of the fluid delivery tool for delivery of the fluid in the fluid container to the fluid delivery tool, the fluid container further having a body portion integral with and distinct from the connector portion of the fluid container; and a key element provided on at least a portion of the fluid container body portion and configured to mate with the key element portion of the tool template.

Still further in accordance with the purpose of the invention, as embodied and broadly described herein, the invention comprises a fluid container for use in a fluid delivery tool having a connector element and a location for holding a fluid container, the location including a replaceable template having a first key element portion, the fluid container including: a connector portion for connecting the fluid container to the connector element of the fluid delivery tool for delivery of the fluid in the fluid container to the fluid delivery tool; and a second key element portion distinct from the connector portion and configured to mate with the first key element portion of the tool template.

Still even further in accordance with the purpose of the invention, as embodied and broadly described herein, the invention comprises a fluid delivery system for use with a fluid delivery tool having a connector element and a location for holding a fluid container, the location including a replaceable template having a key element portion, the fluid delivery system including: a fluid container having a connector portion for connecting the fluid container to the connector element of the fluid delivery tool for delivery of the fluid in the fluid container to the fluid delivery tool, the fluid container further having a body portion integral with and distinct from the connector portion of the fluid container; and a key element provided on at least a portion of the fluid container body portion and configured to mate with the key element portion of the tool template.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification illustrate embodiments of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
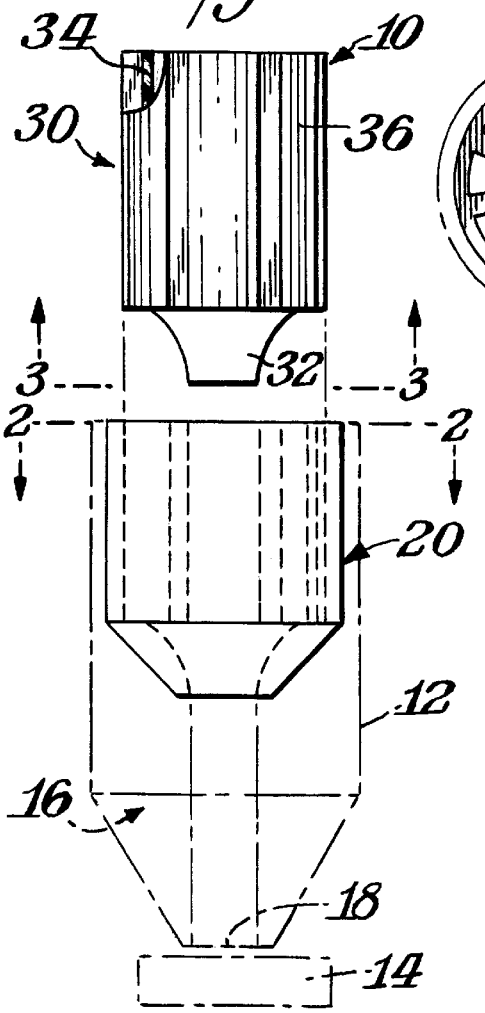
FIG. 1 is an exploded view showing a fluid container with a keyed cover, and mating, keyed template within and a fluid delivery tool (shown in phantom) in accordance with an embodiment of the present invention.

The present invention is drawn broadly to a fluid delivery system 10 as shown generally in FIG. 1. The fluid delivery system includes a fluid delivery tool 12 having a connector element 14 and a location 16 for holding a fluid container. Fluid delivery tool 12 may include any tool capable of delivering a fluid for a manufacturing process. More preferably, fluid delivery tool 12 includes any tool capable of delivering fluids such as liquid chemicals, including but not limited to acids, solvents, bases, photoresists, dopants, inorganics, organics, biological solutions, pharmaceuticals, and radioactive chemicals. Even more preferably, fluid delivery tool 12 includes any semiconductor fabrication tool capable of delivering fluids such as the aforementioned liquid chemicals.

Connector element 14 may include any conventional means for connecting a fluid container to a fluid delivery tool. For example, connector element 14 may include a probe or a tube that connects to a conventional pump in fluid delivery tool 12. Such a probe or tube contacts the fluid in the fluid container to enable the pump to supply the fluid to fluid delivery tool 12.

Figure 2:
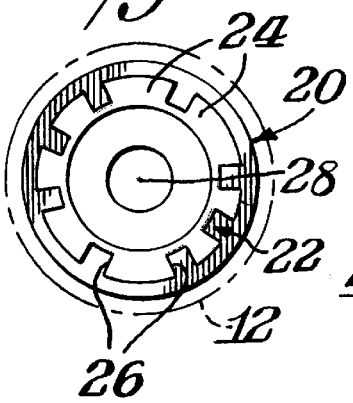
FIG. 2 is a top plan view of the mating, keyed template, taken along line 2—2 of FIG. 1

Location 16 includes a recess or opening formed in fluid delivery tool 12 that is sized to accommodate a removable, replaceable template 20 and communicate with connector element 14, via an opening 18 provided therein. As best shown in FIG. 2, replaceable template 20 has a key element portion 22 that may include a plurality of recesses 24 interspersed with a plurality of tongues 26, although key element portion 22 is not limited to such a configuration, as described below. Replaceable template 20 further includes an opening 28 that communicates with connector element 14, via opening 18 formed in location 16.

Fluid delivery system 10 further includes a fluid container 30 having a connector portion 32 (or nozzle), for connecting fluid container 30 to connector element 14 of fluid delivery tool 12, and a body portion 34 integral with and distinct from connector portion 32. Fluid container 30 may include any container capable of storing and delivering a fluid for a manufacturing process. More preferably, fluid container 30 includes any container capable of storing and delivering fluids such as liquid chemicals, including but not limited to acids, solvents, bases, photoresists, dopants, inorganics, organics, biological solutions, pharmaceuticals, and radioactive chemicals. Even more preferably, fluid container 30 includes any container capable of storing and delivering fluids, such as the aforementioned liquid chemicals, for use in a semiconductor fabrication process.

Figure 3:
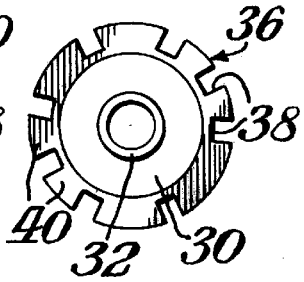
FIG. 3 is a top plan view of the fluid container with keyed cover, taken along line 3—3 of FIG. 1.

As best seen in FIG. 2, connector portion 32 of fluid container 30 communicates with connector element 14, via openings 18, 28, for delivery of the fluid in fluid container 30 to fluid delivery tool 12. As shown in FIGS. 2 and 3, fluid delivery system 10 may further include a key element 36 provided on at least a section of body portion 34 of fluid container 30, and preferably on the entire body portion 34 of fluid container 30. Key element 36 is configured to mate with a corresponding key element portion 22 of tool template 20. As best shown in FIG. 3, key element 36 may include a plurality of grooves 38 interspersed with a plurality of projections 40, although key element 36 is not limited to such a configuration, as described below.

Figure 5:
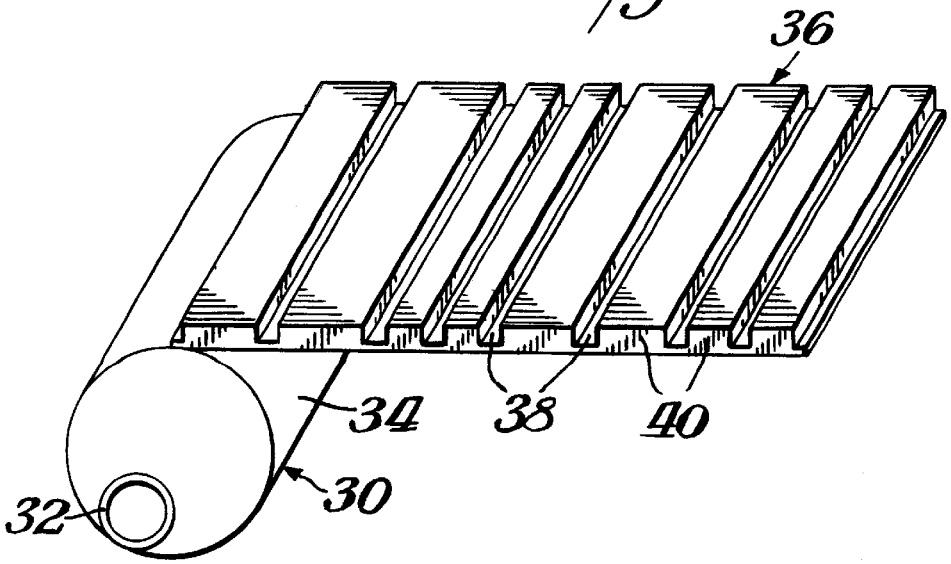
FIG. 5 is a perspective view showing the replaceable, keyed cover ready to wrap around the fluid container shown in FIG. 1.
Figure 6:
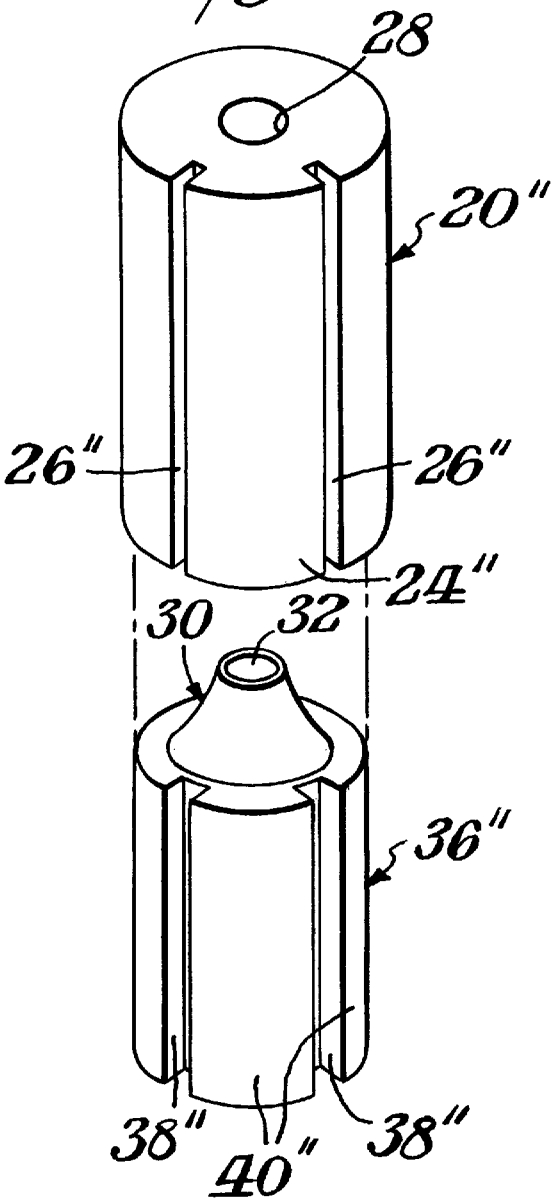
FIG. 6 is an exploded perspective view showing a fluid container with another keyed cover, and another mating, keyed template in accordance with another embodiment of the present invention.
Figure 7:
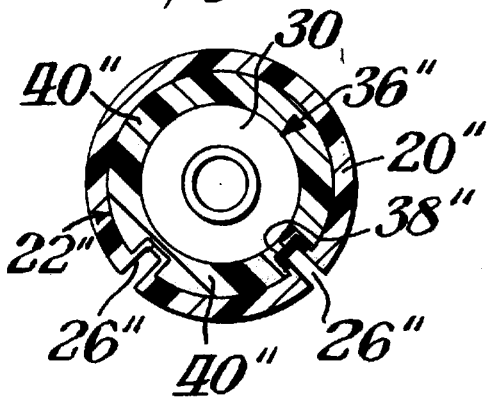
FIG. 7 is an assembled fluid container with the keyed cover (shown in cross-section), and inserted in the mating, keyed template (also shown in cross-section), as shown in FIG. 6.
Figure 8:
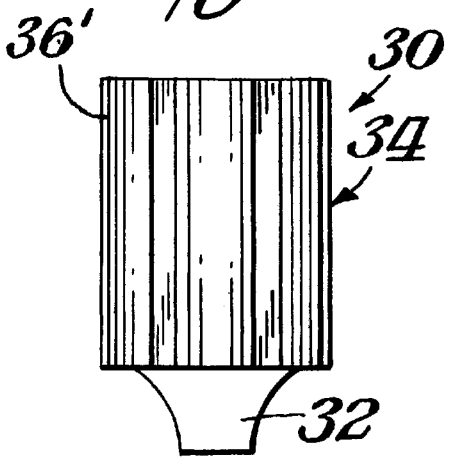
FIG. 8 is a side view of a fluid container with a keyed portion integrally provided on a body portion thereof and in accordance with still another embodiment of the present invention.

Key element 36 may take many forms. For example, as shown in FIG. 5 key element 36 may take the form of a "wrap" that may be removably attached to body portion 34 of fluid container 30. A removable key element 36 wrap may then reusable when fluid container 30 is empty. As shown in FIG. 6, key element 36 may take the form of a "sleeve" or "boot" into which body portion 34 of fluid container 30 may be removably placed. Such a key element 36 sleeve may also be reused when fluid container 30 is empty. Alternatively, the wrap or sleeve versions of key element 36 may be permanently affixed to body portion 34 of fluid container 30, via any conventional attachment means, e.g., glue, adhesive, heat stress, etc. As shown in FIG. 8, key element 36 may also be integrally formed with body portion 34 of fluid container 30, such that the plurality of projections 40 extend away from body portion 34 of fluid container 30. Such a fluid container 30 having integrally-formed key elements 36 may be specially manufactured, such as, for example, via a molding or an extrusion process.

Figure 4:
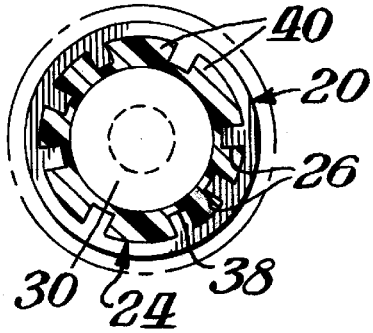
FIG. 4 is an assembled fluid container with the keyed cover (shown in cross-section), and inserted in the mating, keyed template of the fluid delivery tool, as shown in FIG. 1.

As shown in FIG. 4, when fluid container 30 is inserted into replaceable template 20, the plurality of projections 40 of key element 36 mate with the plurality of recesses 24 formed in key element portion 22 of template 20, and the plurality of tongues 26 of key element portion 22 mate with the plurality of grooves 38 formed in key element 36.

Key element 36 has a unique configuration of recesses 38 and projections 40 that correspond with the particular fluid in fluid container 30. Thus, each fluid has its unique key element 36, with a corresponding unique configuration of grooves 38 and projections 40. For example, as shown in FIG. 3, fluid container 30 filled with a specific fluid may have a key element 36 with eight variably dimensioned grooves 38 and projections 40, spaced at variable dimensions, although grooves 38 and projections 40 may have variable dimensions, shapes, and spacings. A fluid container 30 filled with other fluids may have other unique configurations, such as the one shown in FIG. 6. In this design, key element 36" has two grooves 38" that mate with corresponding tongues 26" of key element portion 22", and two projections 40" (one small and one large). Single or multiple grooves 38, projections 40, recesses 24, and tongues 26, having varying shapes, sizes, and spacings, may be used to create hundreds of combinations, each corresponding to a particular fluid.

Fluid delivery system 10 utilizes one particular fluid for each manufacturing process step requiring a fluid, Thus, each process step is correlated with a key element 36 with a unique configuration grooves 38 and projections 40, as well as with a key element portion 22 of template 20 that has a unique configuration of recesses 24 and tongues 26. Each unique configuration of grooves 38 and projections 40 then corresponds with a unique configuration of recesses 24 and tongues 26, and thus, each key element 16 and key element portion 22 corresponds with the particular fluid to be used for that step in the process. In this way, only one unique key element 36 and one unique configuration of grooves 38 and projections 40 will properly interconnect with one unique key element portion 22 and one unique configuration of recesses 24 and tongues 26. Thus, only one fluid can be used with one step in the manufacturing process, and cannot be improperly loaded into a fluid delivery tool 12.

It should be recognized that other configurations of key elements 36 and key element portions 22 may be utilized to perform the present invention. One important limitation on the various combinations of key elements 36 and corresponding key element portions 22 is that none of the combinations overlap with each other. Each unique combination of grooves 38 and projections 40 for each key element 36 must be configured to mate with only one unique combination of recesses 24 and tongues 26 for each key element portions 22, and vice versa.

One of the key features of this invention is that it physically prevents an incorrect fluid container 30 from being loaded into fluid delivery tool 12. Any attempt to defeat the interlock created by key element 36 of fluid container 30 and key element portion 22 of template 20 would be either physically impossible or extremely evident, making it unlikely to occur in a manufacturing environment. An additional advantage relative to conventional systems is that this greatly decreases the opportunity for cross-contamination of a nozzle or probe of fluid delivery tool 12.

It will be apparent to those skilled in the art that various modifications and variations can be made in the fluid delivery system of the present invention and in construction of this system without departing from the scope or spirit of the invention. Examples of which were provided previously.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fluid delivery system, comprising:

a fluid delivery tool having a connector element and a location, the location including a replaceable template having a first key element portion; and a fluid container held in the location of said fluid delivery tool and having a connector portion for connecting said fluid container to the connector element of said fluid delivery tool for delivery of a fluid in said fluid container to said fluid delivery tool, said fluid container further having a second key element portion distinct from the connector portion of said fluid container and configured to mate with the first key element portion of the replaceable template.

2. A fluid delivery system as recited in claim 1, wherein only the second key element portion of said fluid container that mates with the first key element portion of the replaceable template presently located in said fluid delivery tool may be inserted in the location of said fluid delivery tool.

3. A fluid delivery system as recited in claim 1, wherein said fluid delivery tool comprises a semiconductor fabrication tool, and said fluid container is for holding chemicals used in the semiconductor fabrication tool.

4. A fluid delivery system as recited in claim 1, wherein the first key element portion of the replaceable template comprises a plurality of recesses and tongues, and the second key element portion of said fluid container comprises a plurality of grooves and projections configured to mate with the plurality of recesses and tongues of the first key element portion of the replaceable template.

5. A fluid delivery system, comprising:

a fluid delivery tool having a connector element and a location, the location including a replaceable template having a key element portion;

a fluid container held in the location of said fluid delivery tool and having a connector portion for connecting said fluid container to the connector element of said fluid delivery tool for delivery of a fluid in said fluid container to said fluid delivery tool, said fluid container further having a body portion integral with and distinct from the connector portion of said fluid container; and a key element provided on at least a portion of said fluid container body portion and configured to mate with the key element portion of the replaceable template.

6. A fluid delivery system as recited in claim 5, wherein said key element is removable from the body portion of said fluid container.

7. A fluid delivery system as recited in claim 5, wherein said key element is permanently attached to at least a portion of said fluid container body portion.

8. A fluid delivery system as recited in claim 5, wherein only the key element that mates with the key element portion of the replaceable template presently located in said fluid delivery tool may be inserted in the location of said fluid delivery tool.

9. A fluid delivery system as recited in claim 5, wherein said fluid delivery tool comprises a semiconductor fabrication tool, and said fluid container is for holding chemicals used in the semiconductor fabrication tool.

10. A fluid delivery system as recited in claim 5, wherein the key element portion of the replaceable template comprises a plurality of recesses and tongues, and said key element comprises a plurality of grooves and projections configured to mate with the plurality of recesses and tongues of the key element portion of the replaceable template.

11. A fluid container for use in a fluid delivery tool having a connector element and a location for holding said fluid container, the location including a replaceable template having a first key element portion, said fluid container comprising:

a connector portion for connecting said fluid container to the connector element of the fluid delivery tool for delivery of a fluid in said fluid container to the fluid delivery tool; and a second key element portion distinct from the connector portion and configured to mate with the first key element portion of the replaceable template.

12. A fluid container as recited in claim 11, wherein only said second key element portion of said fluid container that mates with the first key element portion of the replaceable template presently located in the fluid delivery tool may be inserted in the location of the fluid delivery tool.

13. A fluid container as recited in claim 11, wherein the fluid delivery tool comprises a semiconductor fabrication tool, and said fluid container is for holding chemicals used in the semiconductor fabrication tool.

14. A fluid container as recited in claim 11, wherein the first key element portion of the replaceable template comprises a plurality of recesses and tongues, and said second key element portion of said fluid container comprises a plurality of grooves and projections configured to mate with the plurality of recesses and tongues of the first key element portion of the replaceable template.

15. A fluid delivery system for use with a fluid delivery tool having a connector element and a location, the location including a replaceable template having a key element portion, the fluid delivery system comprising:

a fluid container held in the location of the fluid delivery tool and having a connector portion for connecting said fluid container to the connector element of the fluid delivery tool for delivery of a fluid in said fluid container to the fluid delivery tool, said fluid container further having a body portion integral with and distinct from the connector portion of said fluid container; and a key element provided on at least a portion of said fluid container body portion and configured to mate with the key element portion of the replaceable template.

16. A fluid delivery system as recited in claim 15, wherein said key element is removable from the body portion of said fluid container.

17. A fluid delivery system as recited in claim 15, wherein said key element is permanently attached to at least a portion of said fluid container body portion.

18. A fluid delivery system as recited in claim 15, wherein only said key element that mates with the key element portion of the replaceable template presently located in the fluid delivery tool may be inserted in the location of the fluid delivery tool.

19. A fluid delivery system as recited in claim 15, wherein the fluid delivery tool comprises a semiconductor fabrication tool, and said fluid container is for holding chemicals used in the semiconductor fabrication tool.

20. A fluid delivery system as recited in claim 15, wherein the key element portion of the replaceable template comprises a plurality of recesses and tongues, and said key element comprises a plurality of grooves and projections configured to mate with the plurality of recesses and tongues of the key element portion of the replaceable template.

* * * * *